US008490274B2

(12) United States Patent
Asai

(10) Patent No.: US 8,490,274 B2
(45) Date of Patent: Jul. 23, 2013

(54) METHOD OF MOUNTING A FACE PLATE ON A FEMALE-DIE, AND A POSITIONING-JIG USED TO MOUNT THE FACE PLATE ON THE FEMALE-DIE

(75) Inventor: Kazuaki Asai, Kanazawa (JP)

(73) Assignees: Make A Box Co., Ltd., Kanazawa-Shi (JP); Katayama Steel Rule Die Inc., Tokyo (JP)

( * ) Notice: Subject to any disclaimer, the term of this patent is extended or adjusted under 35 U.S.C. 154(b) by 1257 days.

(21) Appl. No.: 12/314,543

(22) Filed: Dec. 12, 2008

(65) Prior Publication Data

US 2009/0205190 A1 Aug. 20, 2009

(30) Foreign Application Priority Data

Dec. 14, 2007 (JP) ..... 2007-9606

(51) Int. Cl.
*B23Q 3/00* (2006.01)

(52) U.S. Cl.
USPC ..... 29/464; 29/465; 29/466; 29/468; 29/243.5; 269/71; 72/446; 493/58; 493/143

(58) Field of Classification Search
USPC ..... 29/464–466, 468, 252, 255, 270, 29/278, 243.5, 243.58; 269/71; 493/58, 143; 279/71; 72/446, 31.11, 31.12, 20.1, 20.2, 72/21.2, 30.11, 30.12; 220/300
See application file for complete search history.

(56) References Cited

U.S. PATENT DOCUMENTS 697,371 A * 4/1902 Sindorf ..... 215/332
1,477,440 A * 12/1923 Grier, Jr. ..... 285/34
2,346,445 A * 4/1944 Merker et al. ..... 217/107
2,743,943 A * 5/1956 Furrer ..... 280/485
2,816,611 A * 12/1957 Dokken ..... 285/374
3,880,313 A * 4/1975 Akers ..... 215/211
4,104,349 A * 8/1978 Hillgenberg ..... 264/153
4,279,355 A * 7/1981 Schwartz et al. ..... 220/300
4,341,498 A * 7/1982 Ellis ..... 413/3
4,494,455 A * 1/1985 Schoch ..... 101/3.1
4,518,377 A * 5/1985 Skinner ..... 493/58

(Continued)

FOREIGN PATENT DOCUMENTS

JP 3429828 * 5/2003

OTHER PUBLICATIONS

Katyama; May 2003; Installation and Mounting Arrangment of Cookie Cutter on Die; English Machine Translation.*

*Primary Examiner* — Jermie Cozart
*Assistant Examiner* — Bayan Salone
(74) *Attorney, Agent, or Firm* — Manabu Kanesaka

(57) ABSTRACT

A positioning-jig 1 used to mount a face plate 15 on the female-die 21, and the positioning-jig 1 comprises a female-part 2 which has a concave part and is attached into the positioning-holes 24 at the male-die 22 detachably, a male-part 6 which comprises an axial part inserted detachably into the concave part of the female-part and a dish-shaped head part connected to the axial part, and further provides a positioning method comprising the following steps; set the positioning-jigs 1 on each positioning-holes 24 and set the marking-members 12 on each positioning-jigs 1; and test run the stamping machine to attaches the male-die 22 and the female-die 21, and adhered the marking-members 12 on the female-die 21; and adhered the face plate 15 on the female-die 21 for the marking-members 12 inside each through-holes.

4 Claims, 9 Drawing Sheets

2

U.S. PATENT DOCUMENTS 4,544,820 A * 10/1985 Johnson ..... 219/69.17
4,816,015 A * 3/1989 Holder et al. ..... 493/355
4,828,539 A * 5/1989 Jonsson et al. ..... 493/395
5,163,593 A * 11/1992 Yamashita ..... 226/74
5,163,894 A * 11/1992 Ogawa ..... 493/468
5,810,233 A * 9/1998 Varidel ..... 225/97
5,946,810 A * 9/1999 Hoelderlin et al. ..... 30/392
6,000,300 A * 12/1999 Plamondon ..... 81/90.2
6,203,482 B1 * 3/2001 Sandford ..... 493/61
6,209,208 B1 * 4/2001 Marinkovich et al. ..... 30/392
6,448,875 B1 * 9/2002 Sciarrino ..... 333/254
6,453,949 B1 * 9/2002 Chau ..... 138/89
6,520,900 B1 * 2/2003 Sandford ..... 493/373
6,523,448 B1 * 2/2003 Chang ..... 83/698.31
6,710,685 B1 * 3/2004 Sciarrino ..... 333/254
6,811,423 B2 * 11/2004 Yoshigi et al. ..... 439/315
6,921,283 B2 * 7/2005 Zahlit et al. ..... 439/489
6,949,184 B2 * 9/2005 Ashton ..... 210/198.1
7,445,589 B2 * 11/2008 Jaen ..... 493/80
7,553,177 B2 * 6/2009 Antonini et al. ..... 439/314
7,861,418 B2 * 1/2011 Kretschmar et al. ..... 30/392
8,104,801 B2 * 1/2012 Wang et al. ..... 292/163
8,105,223 B2 * 1/2012 Graham et al. ..... 493/127
8,323,163 B2 * 12/2012 Asai ..... 493/58
2003/0050164 A1 * 3/2003 Smith et al. ..... 493/143
2005/0093251 A1 * 5/2005 Buchholz et al. ..... 279/19
2005/0159283 A1 * 7/2005 Jaen ..... 493/143
2005/0164860 A1 * 7/2005 Letherer ..... 493/143
2005/0215405 A1 * 9/2005 Corcoran ..... 493/143
2006/0205579 A1 * 9/2006 Boix Jaen ..... 493/143
2008/0209742 A1 * 9/2008 Kretschmar et al. ..... 30/392
2008/0227613 A1 * 9/2008 McKellar et al. ..... 493/354
2009/0205190 A1 * 8/2009 Asai ..... 29/465

* cited by examiner

METHOD OF MOUNTING A FACE PLATE ON A FEMALE-DIE, AND A POSITIONING-JIG USED TO MOUNT THE FACE PLATE ON THE FEMALE-DIE

BACKGROUND OF THE INVENTION AND RELATED ART STATEMENT

1. Field of the Invention

The present invention relates to a method of stamping machine, which has both a male-die and a female-die oppositions and stamping out a sheet and making a fold-line on the sheet at once, in which mounting a face plate on a female-die.

2. Description of the Prior Art

Generally, when a paperboard box (an box body) is made as shown in FIG. 10, stamp out a sheet 28 by Thomson blade (stamp-blade) 26 on a male-die (blank-die) 22 and make a valley fold-line 30 on the sheet 28 by rule-blade 25 on the blank-die 22 at once, and form a blank (stamped sheet) 29, and then bend the blank 29 along the fold-line 30 on it to making for an box body.

Prior art as a blank-die 22 used for stamping a sheet 28 is laser cutting on a block-board and making a slit for Thomson blade as a belt shape according to outline for unfolded box body and also making a slit for rule-blade as a belt shape according to fold-line for unfolded box body, and then fitting the Thomson blade 26 in the slit and also fitting the rule-blade 25 which height is lower than the Thomson blade 26 in the slit, and then making the blank-die 22 in general.

As a stamping process insert a sheet 28 between the blank-die 22 set on the upper side of the stamping machine and the cutting-plate (female-die) 21 set on the lower side of the stamping machine, and the cutting-plate 21 up and then down, and then stamping out the sheet 28 so that blank (stamped sheet) 29 is cut on the given shape by the Thomson blade 26 and also a lot of fold-line 30 are on it by the rule-blade 25 at once. In the next, bend the blank 29 along the fold-line 30 on it and make a box body.

For above structure, it is necessary addition a counter part (says face-cutting) on the cutting-plate 21, for which support to rule a fold-line 30 accurately and prevent to break up on the surface of the fold-line 30.

In recent years, a face plate which has pressure-sensitive adhesive on it back and can be post and peel repeatedly are invented, and the face plate such a leaf so called "face film sheet 17" or "CAD-plate 15", and the plate 15 (17) is adhered to a cutting-plate 21 by it pressure-sensitive adhesive. Because, the plate 15 (17) is not only generally using but also economically use.

For above a face film sheet 17 is making next procedure. Uses the CAD data to making a blank-die 22 and draw the unfolded box body on a film sheet 18, and fix a tape on the rule-blade 25 position corresponding line and make a counter part that seems smooth ridge line and trapezoid viewed from the side, and then cut off the part which Thomson blade 26 touches (see FIG. 8). Also for above a CAD-plate 15 is making next procedure. Uses the CAD data to making a blank-die 22 and draw the unfolded box body on such a Bakelite board (Bakelite is a trademark) 16, and put a groove the rule-blade 25 position corresponding line and make a counter part, and then cut off the part which Thomson blade 26 touches (see FIG. 7).

The method of mounting a face plate on a female-die for stamping machine and positioning-jig disclosed in the prior art JP3429828B2, for example.

[Patent Document 1] JP3429828B2

Prior art as a method of mounting a face plate such as a face film sheet 17 (or a CAD-plate 15) on a cutting-plate 21 for stamping machine is making next procedure. Pull out a blank-die 22 for stamping machine, and set a set-tool on a face film sheet 17, and then set the face film sheet 17 on a rule-blade 25, and push back the blank-die 22 for stamping machine. After that a cutting-plate 21 up and then down, and then moved the face film sheet 17 on the cutting-plate 21 and adhered. On the other way, pull out a blank-die 22 for stamping machine, and make a set-pin on the blank-die 22, and then set a CAD-plate 15 with set-holes inserted that the set-pins, and push back the blank-die 22 for stamping machine. After that a cutting-plate 21 up and then down, and then moved the CAD-plate 15 on the cutting-plate 21 and adhered (see FIG. 9). A face film sheet 17 (or a CAD-plate 15) is shows the symbol 34 in FIG. 9.

However, in the above method by using the set-tool such as the set-hole and the set-pin, the face film sheet 17 (or a CAD-plate 15) is hang under their own weight (see symbol 34 in FIG. 9). Therefore, when push back the blank-die 22 for stamping machine, the accident happened with the face film sheet 17 (or a CAD-plate 15) being caught on a chain guide of stamping machine, so that the face film sheet 17 (or a CAD-plate 15) came off, and quit difficult to move the face film sheet 17 (or a CAD-plate 15) on the cutting-plate 21 and adhered (see FIG. 9).

In addition, patent document 1 (JP3429828B2) is about a method of mounting a face plate on a female-die for stamping machine and positioning-jig, and it is not described in regard to mounting the face film sheet 17 (or a CAD-plate 15) on the stamping machine. Prior art shows as a method of alignment with blank-die 22 and cutting-plate 21 that is inserted guide-pin on the cutting-plate 21 the guide-hole on the blank-die 22.

The present invention has been proposed in view of the conventional actual situation, and the object thereof is to provide a method of mounting a face plate on a female-die for stamping machine, stamping out a sheet and making a fold-line on the sheet at once, and a positioning-jig used to mount the face plate on the female-die, wherein no accident with a face plate being caught on the chain when push back the blank-die for stamping machine, and mounted a face plate with high accuracy.

SUMMARY OF THE INVENTION

The present invention provides a method of mounting a face plate on a female-die that is constructed a stamping machine; and the stamping machine has a male-die that is opposite side of the female-die; and the male-die has a stamp-blade according to outline of a unfolded box body and a rule-blade according to a valley fold-line of the unfolded box body; and the face plate such as a plate or a film sheet that has a groove to accept a projection according a hill fold-line as to be opposed the valley fold-line; and the face plate is stick on the female-die; and the stamping machine stamping out a sheet inserted and making the fold-line on the sheet at once; wherein the male-die has two or more positioning-holes at a given interval for positioning the face plate, wherein the face plate has two or more through-holes that a one-to-one correspond to the positioning-holes, and two or more marking-members that has an adhesive layer at the back and stick the adhesive layer on the female-die at the through-hole positions used by the positioning-jig that has the marking-member detachably, and further provides a positioning method comprising the following steps; set the positioning-jigs on each positioning-holes and set the marking-members on each positioning-jigs exposed the adhesive layer; and test run the stamping machine to attaches the male-die and the female-die, and adhered the marking-members on the female-die; and adhered the face plate on the female-die for the marking-members inside each through-holes.

When above the female-die is made of a metal, the present invention provides above the marking-members that has a magnetic layer at the back and stick the magnetic layer on the female-die via magnetic force themselves at the through-hole positions used by the positioning-jigs that has the positioning-members detachably, and further provides a positioning method comprising the following steps; set the positioning-jigs on each positioning-holes and set the marking-members on each positioning-jigs exposed the magnetic layer; and test run the stamping machine to attaches the male-die and the female-die, and stick the marking-members on the female-die by magnetic force themselves; and adhered the face plate on the female-die for the marking-members inside each through-holes. The female-die made of a metal includes the female-die itself made of a metal as well as the female-die on which a metal plate is mounted in case of the female-die is made of block-board.

With the positioning-jig according the invention, the positioning-jig comprises a female-part and a male-part that fitting together, and it is provided that comprises the steps; set the female-part for the positioning-jig in each positioning-hole; and set the marking-members on each male-part for the positioning-jigs exposed the adhesive layer; and set the male-parts in each female-parts; and test run the stamping machine to attaches the male-die and the female-die, and stick the marking-members on the female-die by magnetic force themselves; and adhered the face plate on the female-die for the marking-members inside each through-holes. Or it is provided that comprises the steps; set the female-part of the positioning-jig in each positioning-hole; and set the marking-members on each male-part of the positioning-jigs exposed the magnetic layer; and set the male-parts in each female-parts; and test run the stamping machine to attaches the male-die and the female-die, and stick the magnetic-members on the female-die; and adhered the face plate on the female-die for the marking-members inside each through-holes.

According to the present invention, a face plate mounted on a female-die with high accuracy, because the face plate is mounted to the female-die guided two or more marking-members at a given interval that on the female-die According to the present invention, use the positioning-jigs and adhered the marking-members on the cutting-plate, or use the positioning-jigs and stick the marking-members on the cutting-plate by magnetic force themselves, so that the face plate mounted on the cutting-plate with high accuracy. Therefore, it is no need a face plate set on a rule-blade directly, so that no accident happens with the face plate being caught on a chain guide of stamping machine. So, there is no problem regarding a face plate adhered on a female-die with high accuracy. And the face plate support to rule a fold-line accurately and prevent to break up on the surface of the fold-line.

BRIEF DESCRIPTION OF THE DRAWINGS

FIG. 1(*b*) is a perspective view showing of the positioning-jig to above the present invention.

DETAILED DESCRIPTION OF PREFERRED EMBODIMENTS

The above and other objects, characteristic features and advantages of the present invention will become apparent to those skilled in the art from the description to be given herein below with reference to the accompanying drawings.

Figure 1A:
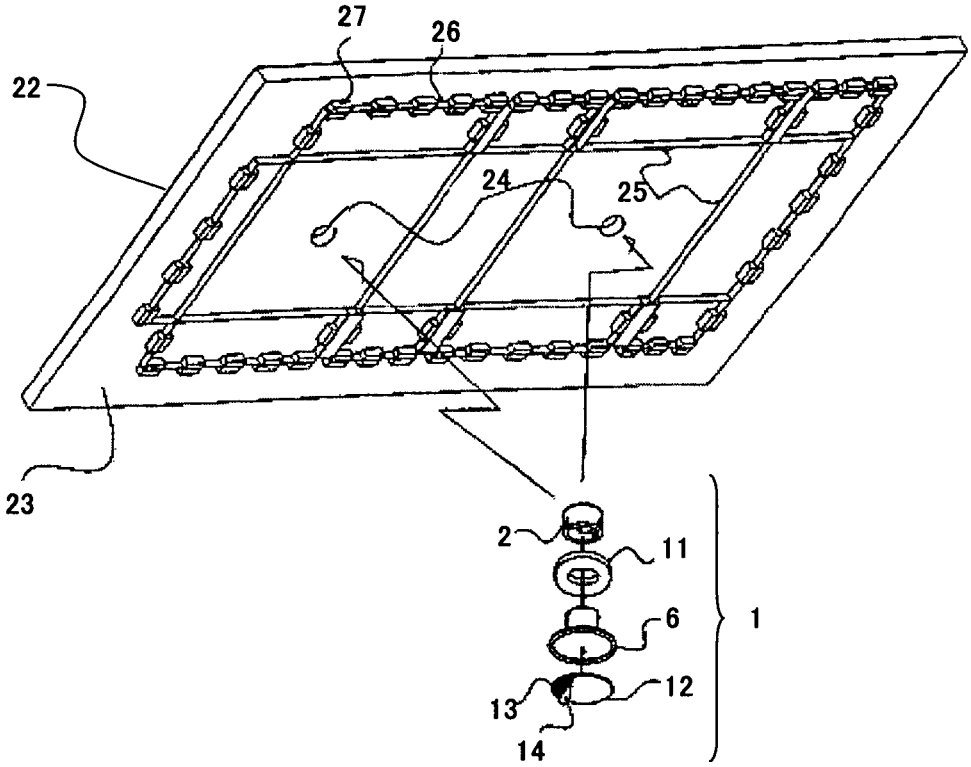
FIG. 1(*a*) is a perspective view showing parts assembly of the positioning-jig to the male-die according to the present invention.
Figure 1B:
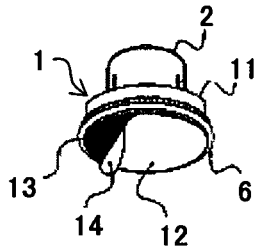

An embodiment of a positioning-jig 1 according to the present invention comprises a female-part 2, a male-part 6, and marking-member 12. FIG. 1(*a*) is a perspective view showing parts assembly of the positioning-jig 1 to the blank-die 22, and it is preferred the height of the positioning-jig 1 set on the blank-die 22 is same as the blank-die 22, or slightly higher than the blank-die 22.

Figure 2:
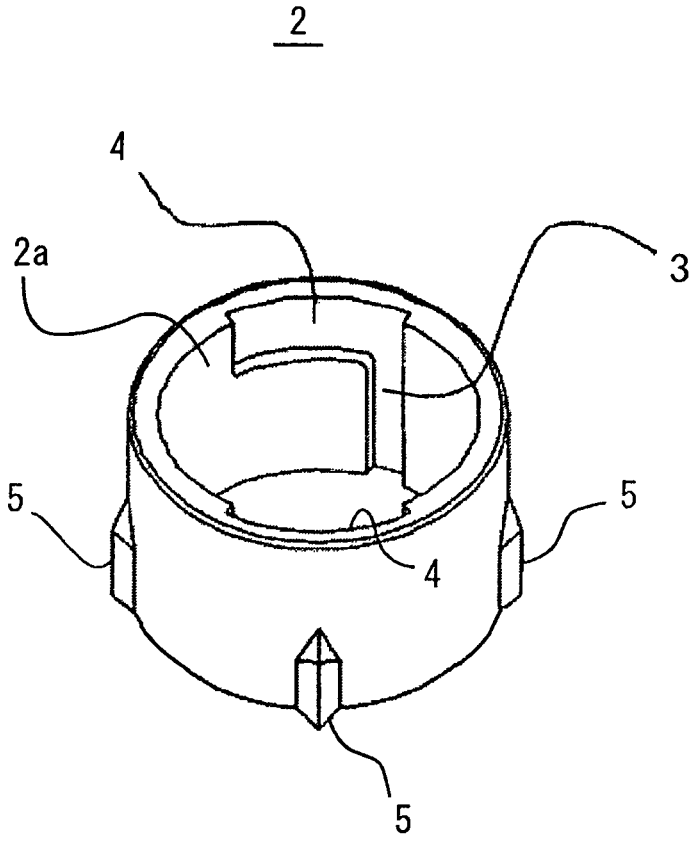
FIG. 2 is a perspective view showing of the female-part for positioning-jig to above the present invention.

FIG. 2 is a perspective view showing of a female-part 2 for positioning-jig 1 according to the present invention. A female-part 2 has formed the longitudinal-thin-wall-part 3 at arbitrary high from a cylindrical inner bottom and on symmetrical positions inner of the cylinder of the predetermined size, a lateral thin wall part 4 extending from an intermediate part between the longitudinal-thin-wall-part 3 and having arbitrary wide, and a number of small and wedge-shaped (or arrowhead-shaped) protuberances 5 in a cylindrical outer bottom.

Figure 3:
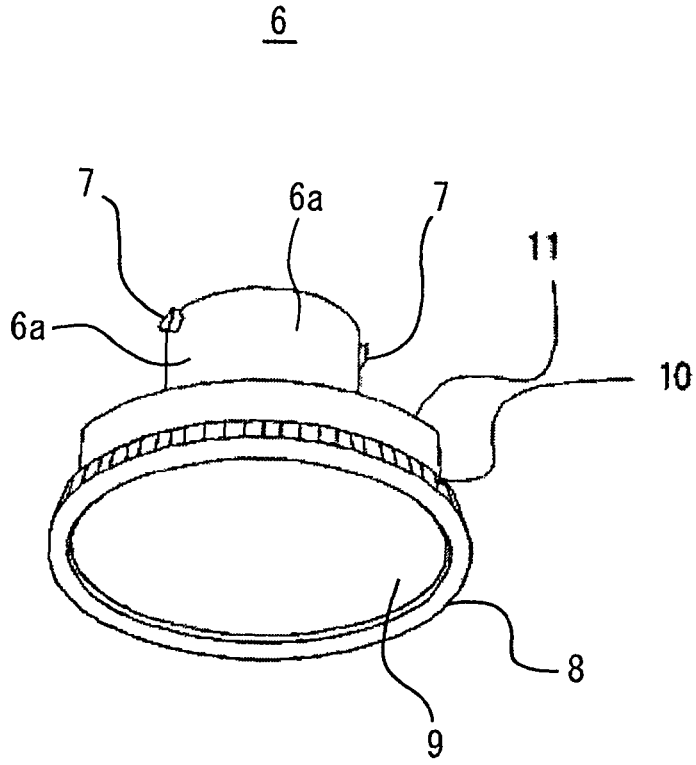
FIG. 3 is a perspective view showing of the male-part for positioning-jig to above the present invention.

FIG. 3 is a perspective view showing of a male-part 6 for positioning-jig according to the present invention. A male-part 6 is an arbitrary height and a predetermined size which enable a male-part 6 to set in a female-part 2, and the male-part 6 includes a cylindrical axial part 6*a*; wherein the cylindrical axial part 6*a* is slightly smaller than a cylindrical inside dimension of the female-part 2 and having an arbitrary embedded space (dent part), is provided with a locking part 7 on symmetrical positions at the top of this cylindrical axial part 6*a* and a dish-shaped head part 8 the bottom of the cylindrical axial part 6*a*. The dish-shaped head part 8 is provided with a circular concavity part 9 of an arbitrary deep and an arbitrary size at the bottom and is put in a flat washer-shaped elastic body 11 of an arbitrary thickness at the top. That is to say, the elastic body 11 is adapted to the axial part 6*a* of the male-part 6, and the elastic body 11 is suppressed to the dish-shaped head part 8, and then is disposed between the female-part 2 and the male-part 6. A spring, a washer, a perforated sponge, and a rubber can be applied to the elastic body 11. And a concavity and convexity nonslip part 10 for preventing fingers from slipping is provided with an external wall on the dish-shaped head part. Thus, after the male-part 6 set in the female-part 2, pinch the nonslip part 10 and screw it, and then the male-part 6 can be detached from the female-part 2.

Figure 4:
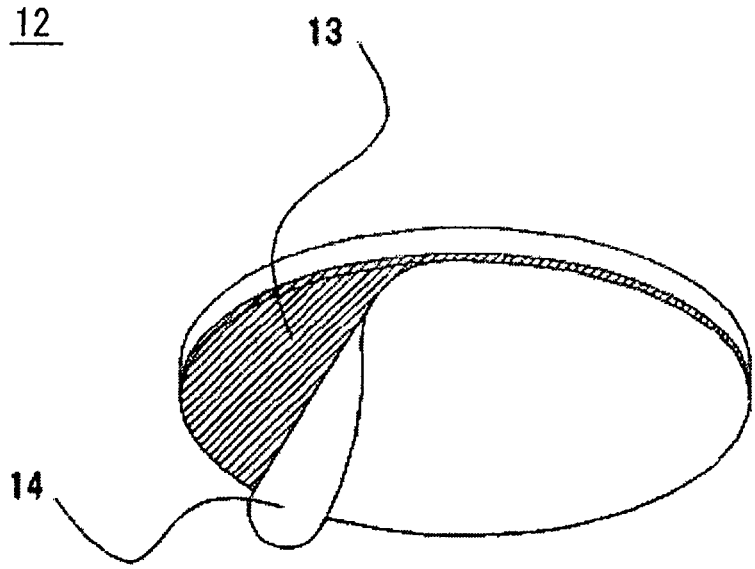
FIG. 4 is a perspective view showing of the marking-member for positioning-jig to above the present invention.

FIG. 4 is a perspective view showing of a marking-member 12 for positioning-jig 1 according to the present invention. A marking-member 12 is a circular-flat plate-shaped matter of a size such as possible to be put in the circular concavity part 9 at the bottom of the dish-shaped head part 8, and a thickness such as it projects from the concavity part 9 at the bottom of the dish-shaped head part 8, and it has a adhesive layer 13 at the bottom. A released paper 14 is covered on a adhesive layer 13. it is preferred the marking-member 12 is made of a sponge or a rubber, because it is easy to adhere to and remove from the female-die 21 made of a metal or the metal plate mounted on the female-die 21.

An example procedure of mounting a face plate on a female-die used the positioning-jigs 1 according to the present invention will be described.

When the blank-die 22 is made, two or more positioning-holes 24 at a given interval for positioning the face plate 15(17), in which a cylindrical part of the female-part 2 can be inserted are formed a block-board 23 at the blank-die 22, and the female-part 2 are inserted into and fixed in each of the positioning-holes 24, so that a number of small and wedge-shaped (or arrowhead-shaped) protuberances 5 are embedded into the blank-die 22 and it prevents the female-part 2 from turning.

Then, the male-part 6 is put into the longitudinal-thin-wall-part 3 that is a cylindrical inner of the female-part 2 by using the locking part 7 of the male-part 6 as a lead and the male-part 6 is turned, and then the locking part 7 of the male-part 6 is set to the lateral thin wall part 4 of the female-part 2. The male-part 6 is let go of there, and then the female-part 2 and the male-part 6 are locked by a bound effective of the flat washer-shaped elastic body 11 of the male-part 6. In addition, the nonslip part 10 is formed in a slope part on the dish-shaped head part 8 of the male-part 6, so that the nonslip part 10 prevents fingers from slipping when the male-part 6 is turned. In addition, because the flat washer-shaped elastic body 11 as a buffer, it is possible to remove easily the male-part 6 from the female-part 2.

Then, the marking-member 12 is set in the circular concavity part 9 at the bottom of the dish-shaped head part 8 of the male-part 6, and the released paper 14 is peeled.

Figure 5:
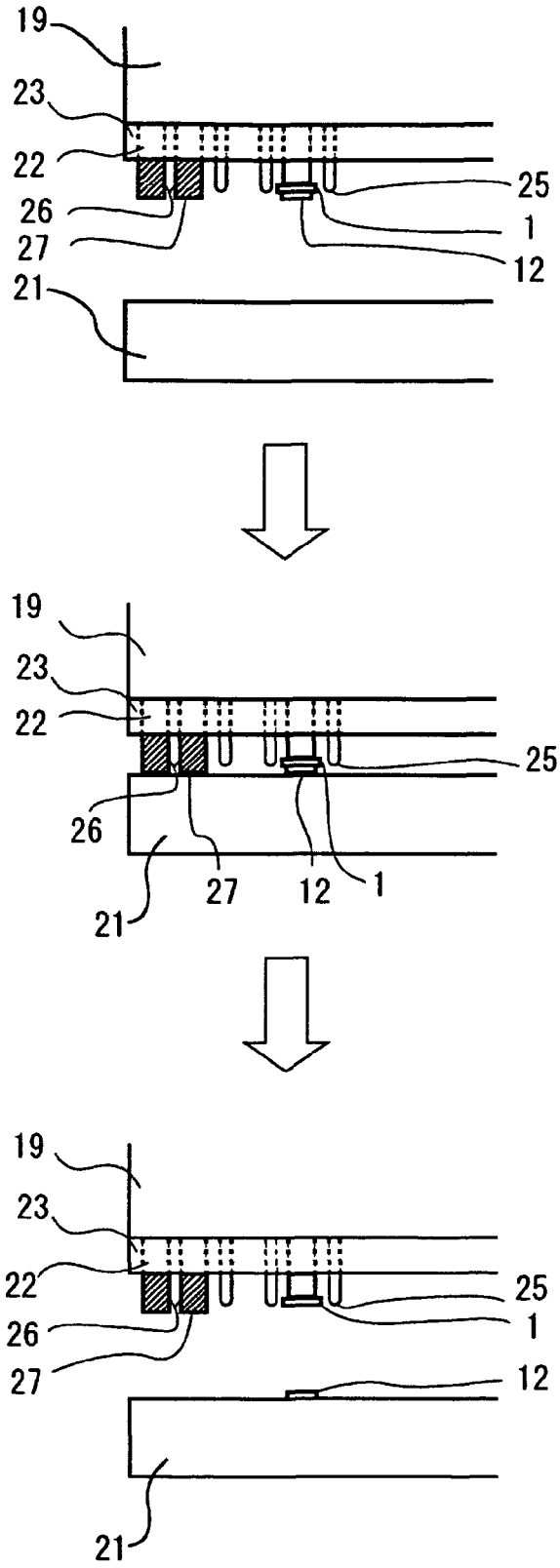
FIG. 5 is a side view showing of the moving procedure of the marking-member moved on the cutting-plate by using above the positioning-jig.

Then, the stamping machine 19 is test run to attaches the blank-die 22 and the cutting-plate 21, and the marking-member 12 is adhered on the cutting-plate 21 (see FIG. 5). The cutting-plate 21 made of a metal. In case of the cutting-plate 21 is made of block-board, a metal plate is mounted on the cutting-plate 21.

Then, the cutting-plate 21 is pull out from the stamping machine 19.

Separately, a face film sheet 17 or a CAD-plate 15, which has two or more through-holes 20 that a one-to-one correspond to the positioning-holes 24 formed in an arbitrarily position on the blank-die 22 when the blank-die 22 is made (see FIG. 1). The paper phenol board such as a Bakelite board (Bakelite is a trademark) 16 is used to the face plate 15(17) here to get a good adhesion for the female-die 21 made of a metal and the flat plate, but it is not limited to above material.

Figure 6:
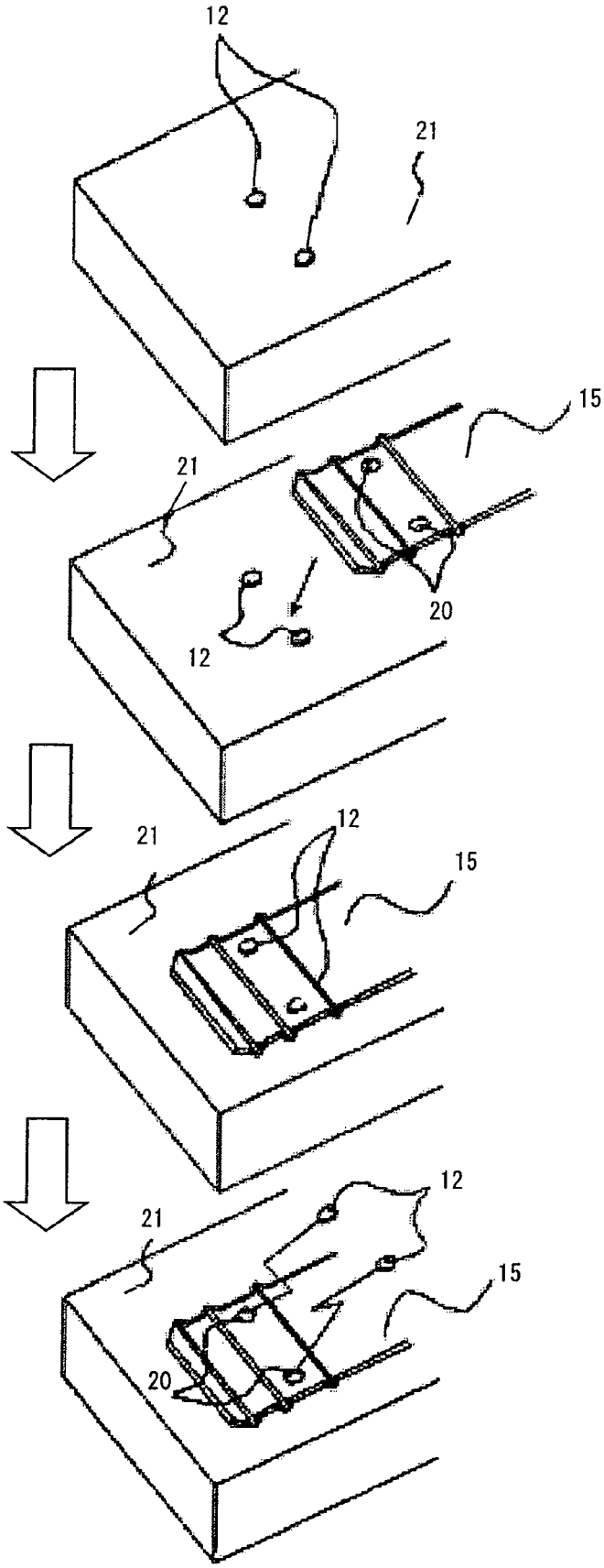
FIG. 6 is a perspective view showing of the setting procedure of the face-plate mounted on the cutting-plate by using above the marking-members.
Figure 7:
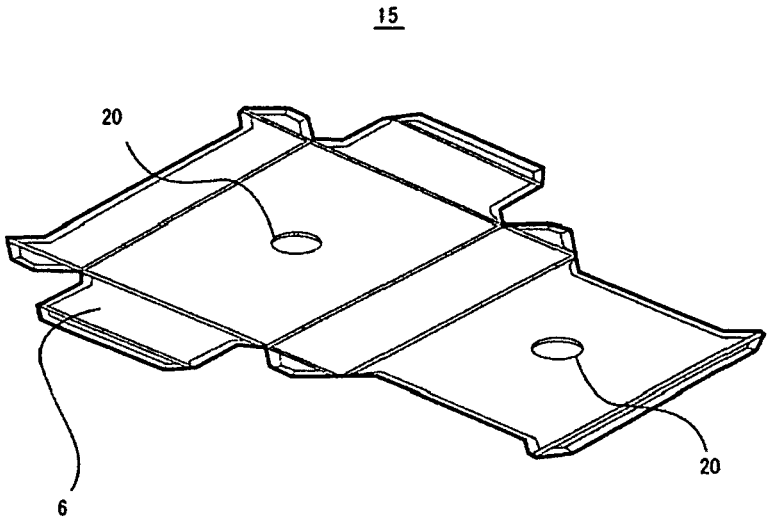
Fig.7 Prior Art
FIG. 7 is a perspective view showing of the CAD-plate as a prior art.
Figure 8:
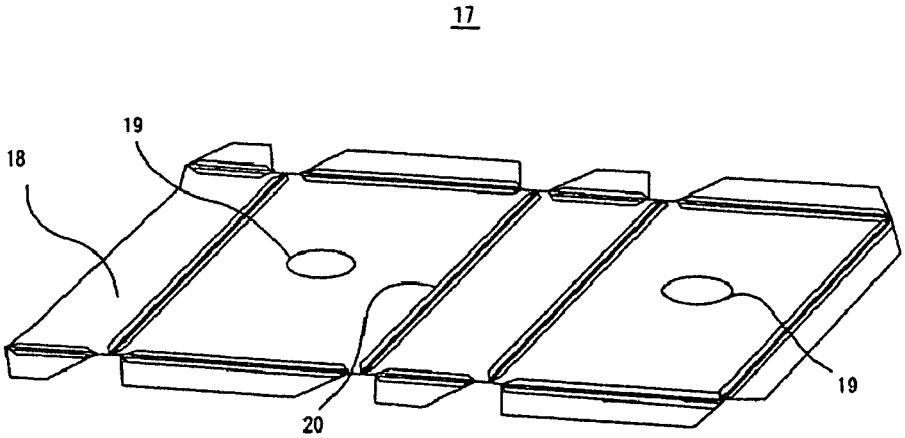
Fig.8 Prior Art
FIG. 8 is a perspective view showing of the face film sheet as a prior art.
Figure 9:
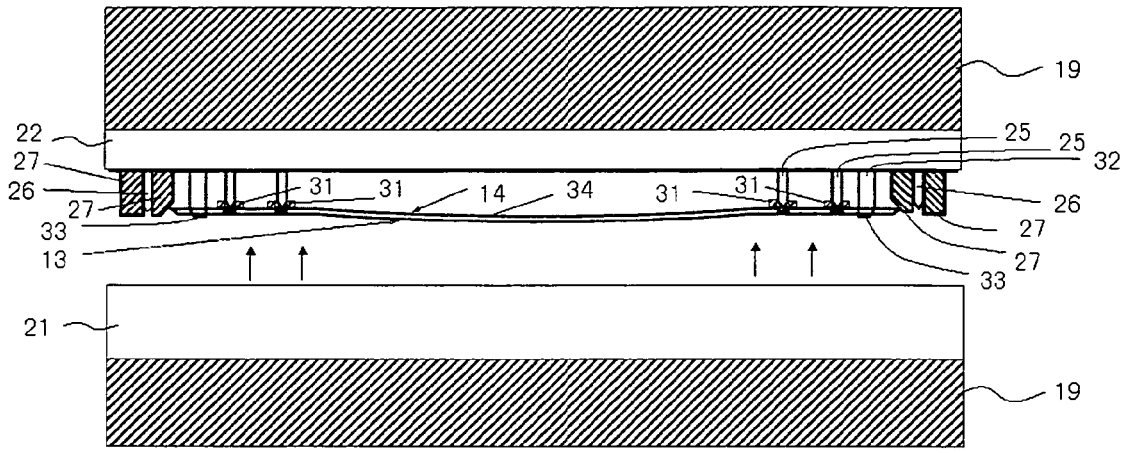
Fig.9 Prior Art
FIG. 9 is a side view showing of the moving procedure of the face plate moved on the cutting-plate by using the set-tool as a prior art.

Then, the marking-member 12 on the cutting-plate 21 is applied to and inserted into the through-holes 20 on face plate 15(17), and then the face plate 15(17) which has pressure-sensitive adhesive on it back adhered on the cutting-plate 21 (see FIG. 6). The face plate 15(17) which has two or more through-holes 20, and it is possible to mount the face plate 15(17) on the cutting-plate 21 without misaligning; and the face plate 15(17) by aligning the circular marking-member 12 on the cutting-plate 21 with the through-holes 20.

Figure 11:
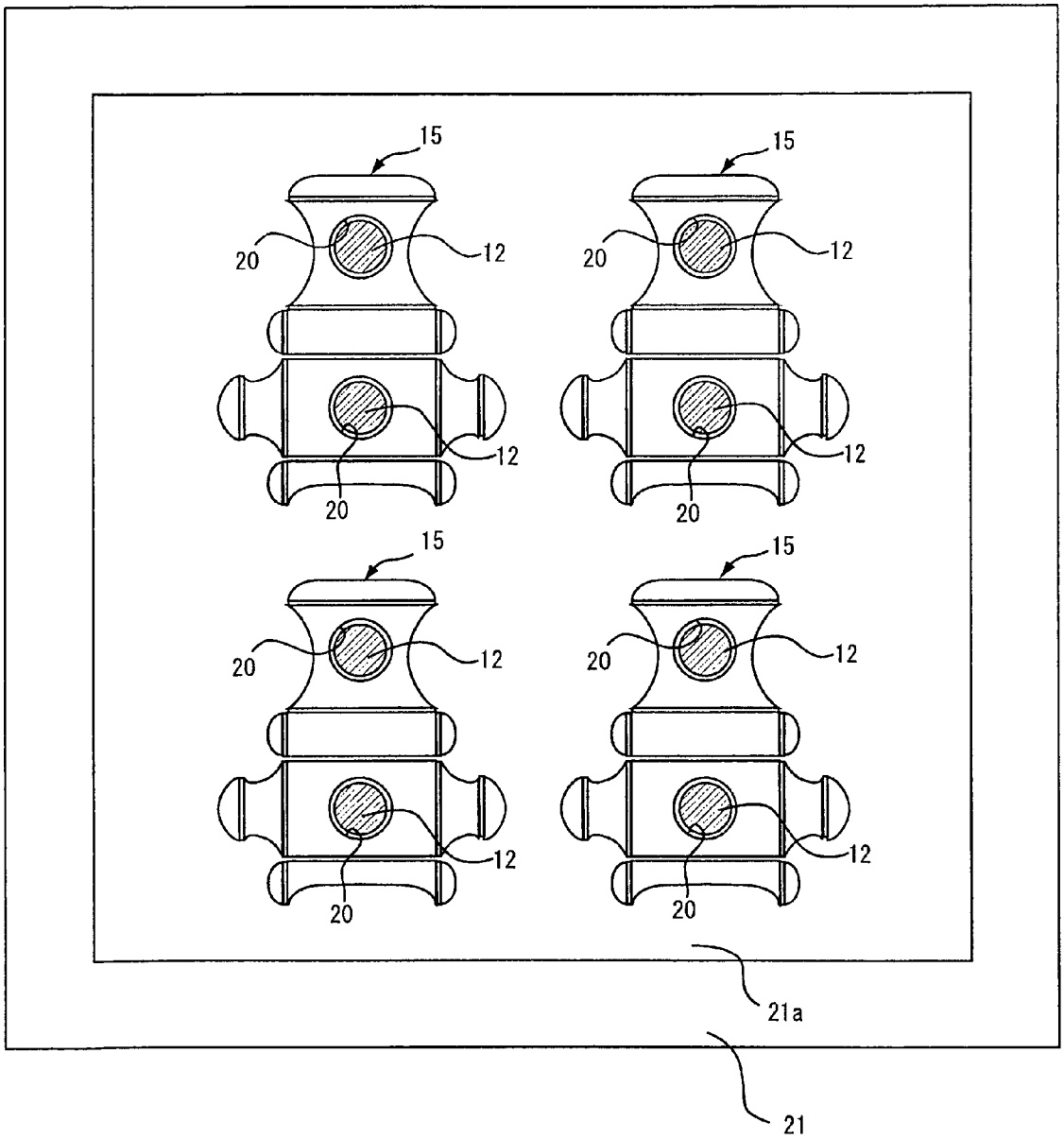
FIG. 11 is a top view showing of four pieces of the face-plates mounted on the cutting-plate by using above the present invention.

In this embodiment here, the thickness of the marking-member 12 is bigger than the thickness of the face plate 15(17). This enables the face plate 15(17) to be mounted easily so that the marking-member 12 is inside the through-holes 20 of the face plate 15(17) as well as the marking-member 12 to be exfoliated easily after the face plate 15(17) is mounted. Additionally not only one sheet of the face plate 15(17) can be mounted but also some sheets of the face plate 15(17) can be mounted at once. As well, it is possible to accommodate for the alignment depending on the embodiment by dissimilating each size of two or more through-holes 20 of the face plate 15(17) and each color of two or more marking-member 12, and marking the given point to the face plate 15(17). In addition, as shown in FIG. 11, it is possible to move some sheets of the face plate 15(17) to the flat plat 21*a* made of the metal laid on the female-die 21 at once.

Next, the marking-member 12 is detached from the surface of the cutting-plate 21, and then the face plate 15(17) is given on the cutting-plate 21 at the position corresponding to the rule-blade 25 of the blank-die 22.

Next, the blank-die 22 is pull out from the stamping machine 19, the male-part 6 is detached from the blank-die 22, and then the blank-die 22 is inserted to the stamping machine 19 again.

Figure 10:
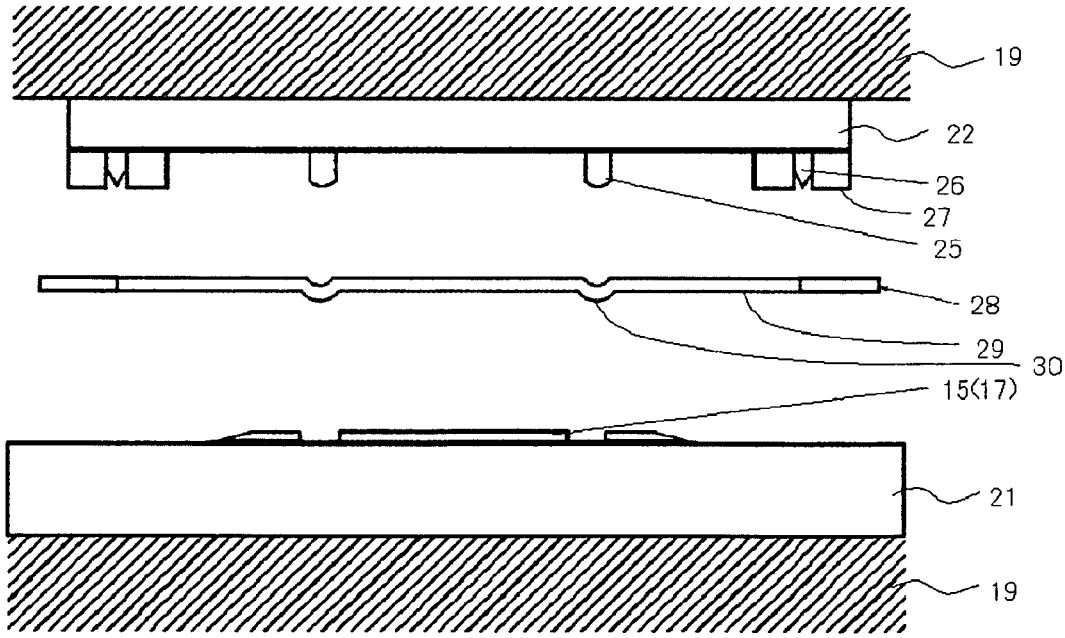
Fig.10 Prior Art
FIG. 10 is a side view showing of the stamping procedure of a sheet inserted between the blank-die set on the upper side of the stamping machine and the cutting-plate set on the lower side of the stamping machine as a prior art.

And then, a sheet 28 inserted between the blank-die 22 set on the upper side of the stamping machine 19 and the cutting-plate 21 set on the lower side of the stamping machine 19 that has the face plate 15(17), and then the sheet 28 is formed a blank (stamped sheet) (see FIG. 10).

In case of a marking-member 12 is made of rubber magnet and a cutting-plate 21 is made of iron, the marking-member 12 can stick on the cutting-plate 21 by magnetic force themselves. Then, marking-member 12 doesn't need any adhesive layer (correspond to claim 2 and 4).

A blank-die 22 used for stamping a sheet 28 is laser cutting on a block-board and making a slit for Thomson blade 26 as a belt shape according to outline for unfolded box body and also making a slit for rule-blade 25 as a belt shape according to fold-line for unfolded box body, and then fitting the Thomson blade 26 in the slit and also fitting the rule-blade 25 which height is lower than the Thomson blade 26 in the slit, and then making the blank-die 22. It is necessary the height of the blade 25, 26 set on the blank-die 22 higher than the female-part 2 set on the blank-die 22. A marking-member 12 is moved to a cutting-plate 21, and after that the height of the male-part 6 set on the blank-die 22 is higher than the blade 25, 26 set on the blank-die 22.

Possibly, a face plate 15(17) which has so-called gel adhesive on it back and gel's given thickness correspond to outer force as for adhesive handling. So, the gel's given elastic property will be support to aliment the face plate 15(17) to the given position at on cutting-plate 21. The gel adhesive applies the whole or part back surface of the face plate 15(17). In addition, the adjustable range is enough if the position of the face plate 15(17) can be shift adjust about 0.1 to 0.2 mm.

As described above, in this embodiment, when a stop position to prevent the female-part 2 and the male-part 6 of the positioning-jig 1 from turning can be confined, as this invention, the shape of the marking-member 12 are not limited to the circular. In this embodiment, it is also described that the female-part 2 and the male-part 6 of the positioning-jig 1 are separate, but, the female-part 2 and the male-part 6 can be combined when the marking-member 12 can be attached detachably and then they can be applied to this invention.

What is claimed is:

1. A positioning-jig used for mounting a face plate on a female-die of a stamping machine, the positioning jig comprising:

a cylindrical female-part having a plurality of protuberances in an arrowhead shape in a cylindrical outer bottom at a predetermined interval, which fits to a predetermined position of the stamping machine, a lateral concave part and another lateral concave part facing each other on a cylindrical inner surface of the female-part and extending in a circumferential direction of the female-part, and a longitudinal concave part and another longitudinal concave part facing each other on the cylindrical inner surface of the female-part and extending in a longitudinal direction of the female-part, wherein an end of the lateral concave part and an end of the longitudinal concave part are connected to form an L-shape, an end of the another lateral concave part and an end of the another longitudinal concave part are connected to form another L-shape, and the L-shape and the another L-shape are symmetrically arranged on the cylindrical inner surface of the female-part;

a male-part having a size capable of being set in the female-part, and having a cylindrical axial part, a locking part and another locking part on a symmetrical position at an upper part of the cylindrical axial part, and a bottom part in a round dish shape at a lower part of the male-part, having a round concave portion extended throughout the bottom part, facing an opposite side where the female-part is attached to position the face plate with the bottom part, and a jagged non-slip part formed on an entire outer circumferential side surface of the bottom part; and a flat washer-shaped elastic body which is set on the bottom part of the male-part, wherein an inner diameter of the elastic body is larger than an outer diameter of the cylindrical axial part, an outer diameter of the elastic body is smaller than an outer diameter of the bottom part, the locking part and the another locking part fit into the longitudinal concave part and the another longitudinal concave part in a longitudinal side of the L-shape and a longitudinal side of the another L-shape respectively when the male-part is attached to the female-part, the locking part and the another locking part slide into the lateral concave part and the another lateral concave part in a lateral side of the L-shape and a lateral side of the another L-shape respectively when the male-part is rotated by a predetermined angle while the male-part is attached to the female-part, and the female-part and the male-part are locked together with a repelling force of the elastic body while the male-part is attached to the female-part.

2. The positioning jig according to claim 1, wherein the lateral concave part, the another lateral concave part, the longitudinal concave part, and the another longitudinal concave part have a predetermined concave depth throughout the L-shape and the another L-shape with respect to a thickness of the female-part.

3. The positioning jig according to claim 2, wherein the lateral side of the L-shape and the lateral side of the another L-shape are present on an upper part of the female-part when the male-part is attached to the female-part.

4. The positioning jig according to claim 1, further comprising a marking-member put in the round concave portion of the bottom part, said marking-member being formed of a circular-flat plate and having an adhesive layer at a bottom thereof.

* * * * *